US009265312B2

(12) United States Patent
Chow

(10) Patent No.: US 9,265,312 B2
(45) Date of Patent: Feb. 23, 2016

(54) OUTDOOR UMBRELLA WITH REMOTE TOUCH-CONTROLLED LED LIGHTS

(71) Applicant: Excellent Limited, Hong Kong (CN)

(72) Inventor: Cheuk Kei Chow, Hong Kong (CN)

(73) Assignee: EXCELLENT LIMITED, Hong Kong (CN)

( * ) Notice: Subject to any disclaimer, the term of this patent is extended or adjusted under 35 U.S.C. 154(b) by 0 days.

(21) Appl. No.: 14/519,651

(22) Filed: Oct. 21, 2014

(65) Prior Publication Data

US 2015/0237976 A1 Aug. 27, 2015

(30) Foreign Application Priority Data

Feb. 24, 2014 (CN) ..... 2014 2 0078485 U

(51) Int. Cl.

| | |
|---|---|
| ***A45B 3/02*** | (2006.01) |
| ***A45B 23/00*** | (2006.01) |
| ***F21V 33/00*** | (2006.01) |
| ***A45B 3/04*** | (2006.01) |
| ***A45B 25/00*** | (2006.01) |
| ***F21V 23/00*** | (2015.01) |
| ***F21V 23/02*** | (2006.01) |
| *F21Y 101/02* | (2006.01) |

(52) U.S. Cl.

CPC ... *A45B 3/02* (2013.01); *A45B 3/04* (2013.01); *A45B 25/00* (2013.01); *F21V 23/004* (2013.01); *F21V 23/02* (2013.01); *F21V 33/0004* (2013.01); *A45B 2025/003* (2013.01); *A45B 2200/1018* (2013.01); *F21Y 2101/02* (2013.01)

(58) Field of Classification Search

USPC ..... 135/910; 362/102

See application file for complete search history.

(56) References Cited

U.S. PATENT DOCUMENTS

| | | | | | |
|---|---|---|---|---|---|
| 5,053,931 | A * | 10/1991 | Rushing | A45B 3/04 | 135/910 |
| 5,502,624 | A * | 3/1996 | Tu | A45B 3/04 | 362/102 |
| 5,954,417 | A * | 9/1999 | Mai | A45B 3/04 | 135/910 |
| 6,126,293 | A * | 10/2000 | Wu | A45B 3/04 | 135/910 |
| 6,270,230 | B1 * | 8/2001 | Mai | A45B 3/04 | 135/910 |
| 6,341,873 | B1 * | 1/2002 | Yang | A45B 3/04 | 135/16 |

(Continued)

FOREIGN PATENT DOCUMENTS

DE 20 2014 102 585 U1 * 8/2014

OTHER PUBLICATIONS

Derwent-ACC-No. 2014-S89945, 1 page printed abstract of CN 203735617 U, Jul. 30, 2014.*

(Continued)

*Primary Examiner* — Robert Canfield

(74) *Attorney, Agent, or Firm* — Muncy, Geissler, Olds & Lowe, P.C.

(57) ABSTRACT

The present invention discloses an outdoor umbrella with remote touch-controlled LED lights comprising an umbrella assembly which includes an upper support pole, a lower support pole, a plurality of umbrella support bars and a plurality of support rails, wherein a plurality of LED lights is respectively provided on the upper portion of the upper support pole, the support rails and the support bars. In view of the above structure, the outdoor umbrella may have a simple structure, and can be easily operated. And the outdoor umbrella is very safe and reliable since providing any electric wire on the umbrella is avoided. In addition, the outdoor umbrella is energy-saving and environmental friendly.

5 Claims, 5 Drawing Sheets

(56) References Cited

U.S. PATENT DOCUMENTS 6,612,713 B1 * 9/2003 Kuelbs ..... A45B 3/00 362/102
7,108,388 B2 * 9/2006 Li ..... A45B 3/04 135/910
7,125,133 B2 * 10/2006 Bilotti ..... A45B 3/04 362/102
7,431,469 B2 * 10/2008 Li ..... A45B 3/00 135/910
2003/0000557 A1 * 1/2003 Lai ..... A45B 3/04 135/15.1
2003/0067765 A1 * 4/2003 Li ..... A45B 3/04 362/102
2004/0100791 A1 * 5/2004 Bilotti ..... A45B 3/04 362/102
2004/0184261 A1 * 9/2004 Lin ..... A45B 3/04 362/102
2005/0041425 A1 * 2/2005 Li ..... A45B 3/04 362/249.01
2006/0005869 A1 * 1/2006 Kuelbs ..... A45B 3/00 135/20.3
2006/0070642 A1 * 4/2006 Lo ..... A45B 3/04 135/16
2006/0120067 A1 * 6/2006 Kuelbs ..... A45B 3/04 362/129
2007/0056617 A1 * 3/2007 Li ..... A45B 3/04 135/91
2007/0058360 A1 * 3/2007 Li ..... A45B 3/04 362/102
2007/0127231 A1 * 6/2007 Li ..... A45B 3/00 362/102
2008/0122382 A1 * 5/2008 Moriconi ..... F21V 33/006 315/291
2009/0090404 A1 * 4/2009 Kuelbs ..... A45B 3/00 135/16
2009/0251887 A1 * 10/2009 Chronopoulos ..... A45B 3/02 362/102
2010/0192999 A1 * 8/2010 Li ..... A45B 3/02 135/96
2013/0167886 A1 * 7/2013 Crain ..... A45B 3/04 135/16

OTHER PUBLICATIONS

Derwent-ACC-No. 2013-K*6209, 1 page printed abstract of CN 202835146 U, Mar. 27, 2013.*

Derwent-ACC-No. 2010-B46684, 1 page printed abstract of CN 201388639 Y, Jan. 27, 2010.*

* cited by examiner

OUTDOOR UMBRELLA WITH REMOTE TOUCH-CONTROLLED LED LIGHTS

TECHNICAL FIELD

The instant invention is generally directed to the field of outdoor umbrella assembly with illumination. More specifically, the present invention relates to a special outdoor umbrella having a plurality of LED lights, which illumination can be varied by a remote and touch controlling mode according to the surroundings.

BACKGROUND OF THE INVENTION

Nowadays, the outdoor umbrella with illumination in the prior art cannot save energy, and the light cannot be controlled to adjust the brightness by any control means, such as remote control or touch control. Furthermore, the outdoor umbrella with illumination in the prior art fails to protect eyes since the light is naked in the air and not covered by a shade or a panel; and the light of the outdoor umbrella can only be turned on or turned off simply, thus the brightness of the light cannot be adjusted, if desired. In addition, the light of the umbrella should be turned on or turned off manually, and remote control and operation of the light cannot be achieved. Therefore, in order to eliminate the defect of the prior art, the present invention aims to provide an outdoor umbrella with remote touch-controlled LED lights.

SUMMARY OF THE INVENTION

This invention responds to the above need of a new outdoor umbrella, to provide an outdoor umbrella which is provided with LED lights controlled in a remote and touch manner, by which the outdoor umbrella can be easily operated and save electricity. In addition, the brightness of the LED lights can be easily adjusted.

To achieve the above object, the following technical solution is adopted: an umbrella which comprises an umbrella assembly including an upper support pole, a lower support pole, a plurality of umbrella support bars, a plurality of support rails and an umbrella panel that overlays the umbrella support bars, in which the upper end of the upper support pole further includes a self-tapping screw, a pin, a plurality of lamp shades, a plurality of LED lights, a light socket, a first connecting member, a plurality of insulating member, a second connecting member, a sleeve for connecting the support rails, a decorative cover, all of the above are subsequently connected. The lower support pole includes self-tapping screw, a stud, a hanging round, a self-tapping screw, a plurality of sleeves, an aligning pin, a decorative cover, fixing screws, a fixing crane, a plurality of hexagonal screw, a press-button, all of the above are subsequently connected.

In one embodiment, the upper support pole and the lower support pole are hollow, and are connected by a middle connecting member. Specifically, a plurality of LED lights is disposed on the upper end of the upper support pole, in which each LED lights is covered by a lamp shade. The lower support pole is provided with a hole on the upper portion, in which a controller is disposed therein. The hole is covered by a rear door that can be easily opened and closed. In addition, a plurality of LED lights is disposed on the support rails and the support bars, respectively. An electric system having a controller is disposed in the lower support pole, in which the controller includes a power supply PCB being electrically connected with a constant voltage LED driver and a touch PCB. Said touch PCB and the power supply PCB are connected by wires, and an output terminal of the power supply PCB is provided with wires to electrically connect to the LED lights. The touch PCB includes a control panel. The self-tapping screw and the pin are inserted into the light socket. The lampshades are mounted on the upper portion of the upper support pole to connect to the light socket. The LED lights on the upper support pole are connected with the light socket. The first connecting member is disposed in the lower portion of the light socket, in which the first connecting member is disposed in the insulating members. The second connecting member is connected to the upper end of the upper support pole, and the sleeves for connecting the support rail are connected with the support bars.

The self-tapping screw is connected to the upper support pole. The stud is inserted into the upper support pole, in which the hanging round is connected to the upper portion of the stud. The self-tapping screw is inserted into the upper support pole and the sleeves are mounted on the upper support pole. Further, the aligning pin is inserted into the upper support pole and the fixing screws are inserted into the fixing crane which is mounted on the upper end of the lower support pole. The hexagonal screws are inserted into a U-shape clamp though the support rail. The press-button is connected with the lower support pole. And the middle connecting member is located in the middle of the lower support pole. The rear door is connected to the controller. In addition, the LED lights are located on the support rails and the support bars, and the upper end of the umbrella panel that overlays on the support bars is connected with the upper support pole.

The outdoor umbrella with remote touch-controlled LED lights has a simple structure, and can be easily operated. The outdoor umbrella is very safe and reliable since providing any electric wire on the umbrella is avoided. In addition, the outdoor umbrella of the present invention is energy-saving and environmental friendly.

BRIEF DESCRIPTION OF THE DRAWINGS

The features of the present invention may be clearly set forth with reference to the accompanying drawings. The invention, together with the advantages thereof may be best understood by reference to the following description taken in conjunction with the accompany drawings, wherein like reference signs identify like elements, and wherein.

DETAILED DESCRIPTION OF THE INVENTION

The structure of outdoor umbrella of the invention will be explained in detail with reference to the accompany drawings. The description and explanatory embodiments herein are merely used to set forth the present invention, not to limit the invention.

Figure 1:
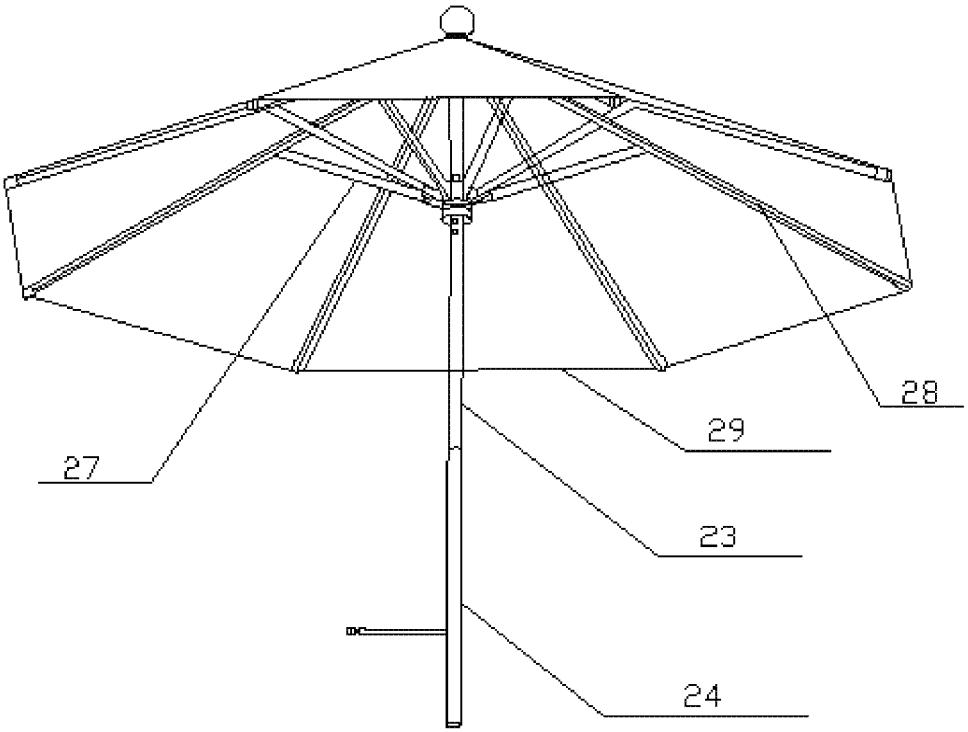
Fig. 1 (Prior Art)
FIG. 1 is a schematic view of an umbrella assembly of the outdoor umbrella with touch-controlled LED lights, according to the present invention.
Figure 2:
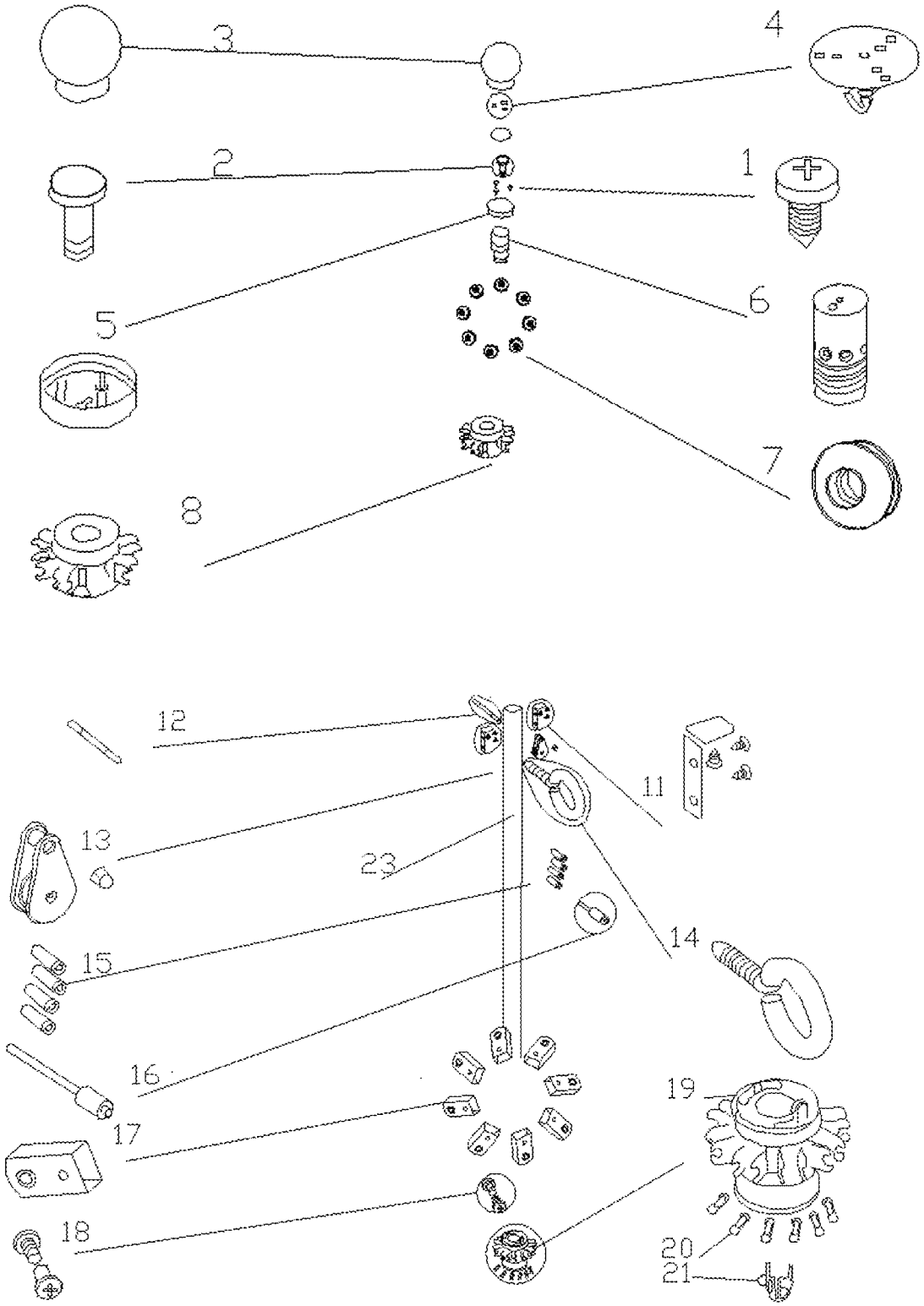
FIG. 2 is a schematic view of the upper portion structure of outdoor umbrella with touch-controlled LED lights according to the present invention, in which some elements are enlarged.
Figure 3A:
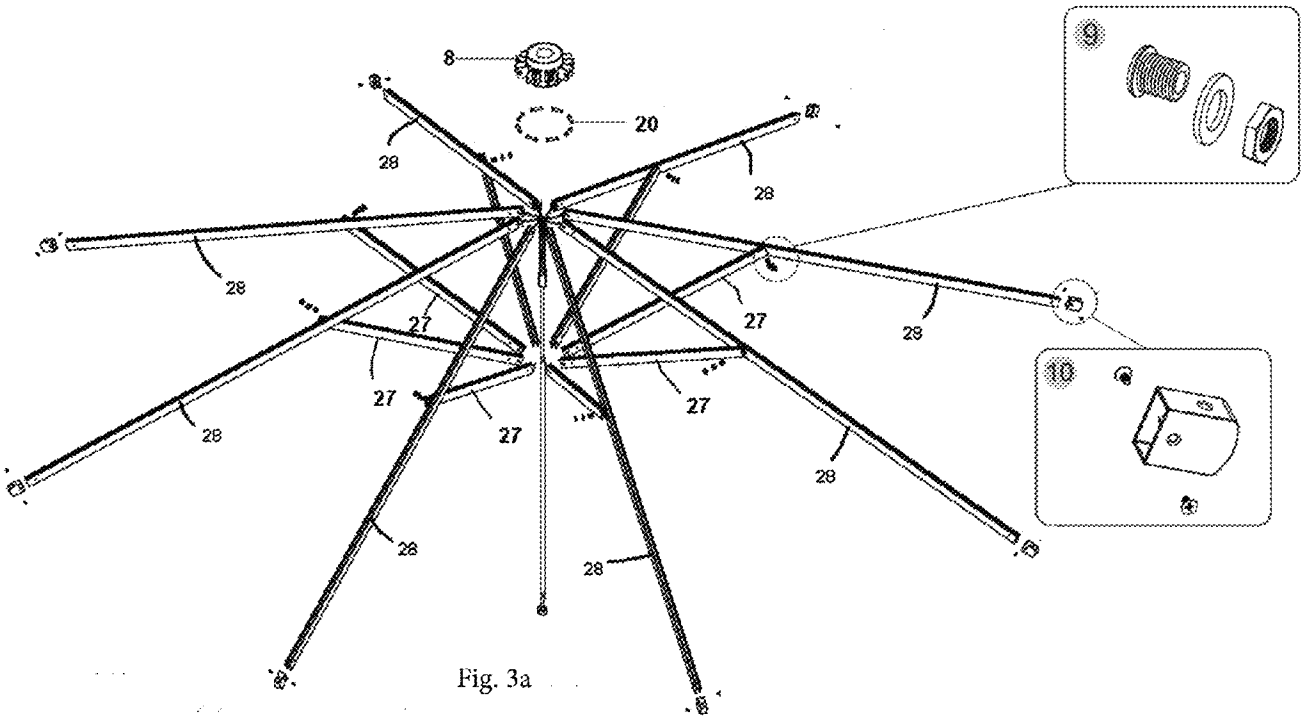
FIG. 3*a* is a schematic view of the support structure and LED lights thereon of the outdoor umbrella.
Figure 3B:
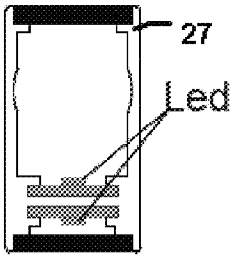
FIG. 3*b* is a cross-section view of support rails 27 of FIG. 3*a;*
Figure 3C:
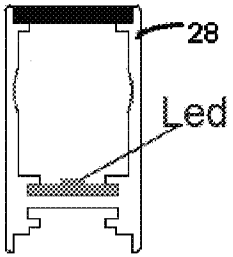
FIG. 3*c* is a cross-section view of support bars 28 of FIG. 3*a;*
Figure 4:
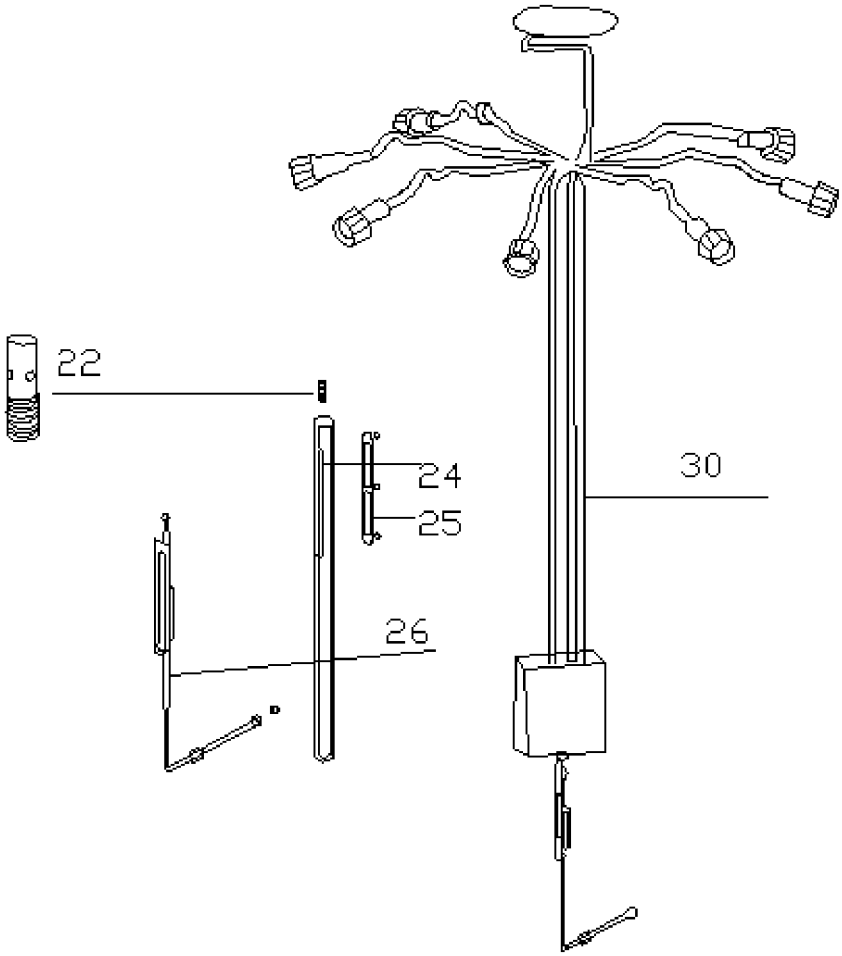
FIG. 4 is schematic view of the upper end and touch-control structure of the outdoor umbrella according to the present invention.

With reference to FIGS. 1-5, an outdoor umbrella with remote-controlled and touch-controlled LED lights of the present invention is disclosed. The said umbrella comprises an umbrella assembly including an upper support pole 23, a lower support pole 24, a plurality of umbrella support bars 28 and a plurality of support rails 27, and an umbrella panel 29 that overlays the umbrella support bars 28. The upper end of the upper support pole 23 includes a self-tapping screw 1, a pin 2, a plurality of lampshades 3, a plurality of LED lights 4, a light socket 5, a first connecting member 6, a plurality of insulating member 7, a second connecting member 8, a sleeve 9 for connecting the support rails 27, a decorative cover 10, all of which are sequentially connected as shown in FIG. 2 from top to bottom.

The lower support pole 24 includes a self-tapping screw 11, a stud 12, a hanging round 13, a self-tapping screw 14, a plurality of sleeves 15, an aligning pin 16, a decorative cover 17, fixing screws 18, a fixing crane 19, a plurality of hexagonal screws 20, a press-button 21, all of which are sequentially connected as shown in FIG. 2 from top to bottom.

The upper support pole 23 and the lower support pole 24 are hollow, and are connected by a middle connecting member 22. Specifically, a plurality of LED lights are disposed on the upper end of the upper support pole 23, in which the LED lights are covered by the lampshade 3. The lower support pole is provided with a hole on the upper portion, in which a controller 26 is disposed therein. The hole is covered by a rear door 25. In addition, a plurality of LED lights are disposed on the support rails 27 and the support bars 28, respectively. An electric system 30 having a controller 26 is disposed in the lower support pole 24, in which the controller 26 includes a power supply printed circuit board (PCB) being electrically connected with a constant voltage LED driver and a touch PCB. Said touch PCB and power supply PCB is connected by 10 wires, and an output terminal of the power supply PCB is provided with 5 wires to electrically connect to the LED lights. The touch PCB includes a control panel. The self-tapping screw 1 and the pin 2 are inserted into the light socket 5. The lampshades 3 are mounted on the upper portion of the upper support pole to connect to the light socket 5. The LED lights on the upper support pole are put to the light socket 5. The first connecting member 6 is disposed in the lower portion of the light socket 5, in which the first connecting member 6 is disposed in the insulating members 7. The second connecting member 8 is connected to the upper end of the upper support pole 23, and the sleeves 9 for connecting the support rail are connected with the support bars 28. The decorative covers 10 and 17 are disposed the cross-section of the umbrella panel 29 and support bars 28, and the cross-section of upper support 23 and the support bars 28 respectively.

The self-tapping screw 11 is connected to the upper support pole 23. The stud 12 is inserted into the upper support pole 23, in which the hanging round 3 is connected to the upper portion of the stud 12. The self-tapping screw 14 is inserted into the upper support pole 23 and the sleeves 15 are mounted on the upper support pole 23. Further, the aligning pin 16 is inserted into the upper support pole 23 and the fixing screws 18 are inserted into the fixing crane 19 which is mounted on the upper end of the lower support pole 24. The hexagonal screws 20 are inserted into a U-shape clamp though the support rail 27. The press-button 21 is connected with the lower support pole 24. And the middle connecting member 22 is located in the middle of the lower support pole 24. The rear door 25 is connected to the controller 26. In addition, the LED lights are provided with the support rail 27 and the support bar 28, and the upper end of the umbrella panel 29 that overlays on the support bars is connected to the upper support pole 23.

Figure 5:
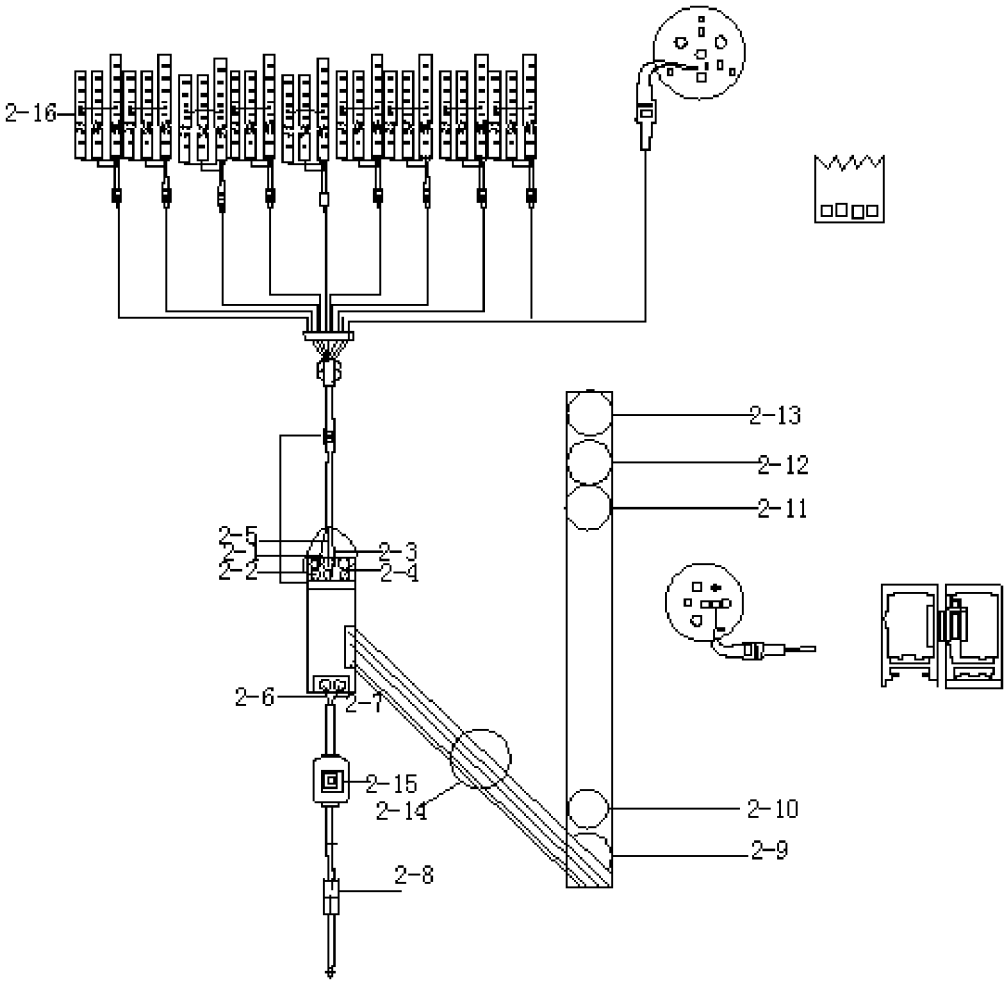
FIG. 5 is a schematic view of the structure of electrical circuit of the outdoor umbrella, according to the present invention.

The electric system 30 includes a controller, several power cords, a plurality of LED lights, and several buttons. Line 2-1 in FIG. 5 is connected to the LED lights of the support bars, Lines 2-2, 2-3 and 2-4 are connected to the LED lights of the support rails respectively. Lines 2-5, 2-6 and 2-7 are public negative level, positive level for LED consistent driver, and negative level for LED consistent driver respectively. Reference signs 2-8, 2-9, 2-14, 2-15 and 2-16 are connecting point for public line and bus line, lines for switch, a main switch and LED lights respectively. Reference signs 2-10, 2-11, 2-12 and 2-13 are buttons which are connected to LED lights.

While a particular embodiment of the invention has been shown and described, it will be obvious to those skilled in the art that changes and modifications can be made without departing from the true spirit and scope of the invention. It should be appreciated that all the embodiments of the present invention described above are illustrative only, and all the changes and modifications made by those skilled in the art are covered by the appended claims.

What is claimed is:

1. An outdoor umbrella with touch-controlled light emitting diode (LED) lights comprising:

an umbrella assembly including an upper support pole, a lower support pole, an umbrella cover, a plurality of umbrella support bars and a plurality of support rails, wherein the upper support pole is connected to the plurality of support bars and the plurality of support rails, wherein the umbrella cover is connected to the plurality of support bars, wherein a plurality of LED lights is disposed in each of the support rails and the support bars, and wherein the lower support pole is provided with a hole in which is a controller including a power supply printed circuit board (PCB) being electrically connected with a constant voltage LED driver, and a touch PCB, said touch PCB and power supply PCB are connected by at least one first wire, and an output terminal of the power supply PCB is provided with at least one second wire to electrically connect to the LED lights.

2. The outdoor umbrella with touch-controlled LED lights according to claim 1, wherein the upper support pole and the lower support pole are connected by a middle connecting member.

3. The outdoor umbrella with touch-controlled LED lights according to claim 1, further comprising: a plurality of LED lamps disposed on an upper portion of the upper support pole each including a lamp shade.

4. The outdoor umbrella with touch-controlled LED lights according to claim 1, wherein a rear door is disposed on the hole.

5. The outdoor umbrella with touch-controlled LED lights according to claim 1, wherein the outdoor umbrella further comprises a controlling panel that is electrically connected to the touch PCB.

* * * * *